US008776883B2

(12) United States Patent
Al-Tahini

(10) Patent No.: US 8,776,883 B2
(45) Date of Patent: Jul. 15, 2014

(54) SAND PRODUCTION CONTROL THROUGH THE USE OF MAGNETIC FORCES

(75) Inventor: Ashraf Al-Tahini, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 474 days.

(21) Appl. No.: 12/773,380

(22) Filed: May 4, 2010

(65) Prior Publication Data

US 2011/0272143 A1 Nov. 10, 2011

(51) Int. Cl.
*E21B 43/16* (2006.01)

(52) U.S. Cl.
USPC ..... 166/305.1; 166/369; 166/66.5

(58) Field of Classification Search
USPC ..... 166/279, 310, 66.5, 248, 250.01, 307, 166/305.1, 369, 276
See application file for complete search history.

(56) References Cited

U.S. PATENT DOCUMENTS

| | | | | |
|---|---|---|---|---|
| 4,378,845 | A | 4/1983 | Medlin et al. | |
| 4,579,173 | A * | 4/1986 | Rosensweig et al. | 166/248 |
| 4,802,534 | A | 2/1989 | Larson et al. | |
| 4,834,898 | A | 5/1989 | Hwang | |
| 5,386,875 | A | 2/1995 | Venditto et al. | |
| 5,443,119 | A | 8/1995 | Chambers et al. | |
| 5,465,789 | A * | 11/1995 | Evans | 166/248 |
| 5,772,877 | A | 6/1998 | Dvorchik et al. | |
| 6,250,848 | B1 | 6/2001 | Moridis et al. | |
| 6,733,668 | B2 | 5/2004 | Pedersen et al. | |
| 7,032,670 | B2 | 4/2006 | Zitha | |
| 7,174,957 | B1 * | 2/2007 | Jokhio | 166/99 |
| 2003/0168216 | A1 * | 9/2003 | Nicholson | 166/297 |
| 2006/0037755 | A1 | 2/2006 | Knobloch | |
| 2006/0185849 | A1 | 8/2006 | Edwards et al. | |
| 2007/0044960 | A1 * | 3/2007 | Lovell et al. | 166/250.07 |
| 2008/0283243 | A1 * | 11/2008 | Rediger et al. | 166/276 |
| 2009/0301718 | A1 | 12/2009 | Baser et al. | |

FOREIGN PATENT DOCUMENTS

| | | | |
|---|---|---|---|
| RU | 2276259 | C2 | 5/2006 |
| SU | 377504 | A | 10/1970 |
| SU | 874990 | B | 2/1980 |

OTHER PUBLICATIONS

PCT Search Report and Written Opinion (PCT/US2011/034296), dated Jul. 5, 2012.

* cited by examiner

*Primary Examiner* — Jennifer H Gay
*Assistant Examiner* — Taras P Bemko
(74) *Attorney, Agent, or Firm* — Bracewell & Giuliani LLP; Constance G. Rhebergen; James M. Sellers

(57) ABSTRACT

A process for controlling the production of loose sand particles within an underground formation through the use of magnetic forces is provided. The loose sand particles are magnetized and then subjected to a magnetic field of sufficient strength such that the operator can control the movement of the loose sand particles within the underground formation. In some instances, the present invention can provide an efficient process for keeping the loose sand particles within the formation, and thereby prolonging the useful life of the downhole equipment. In other instances, the present invention can provide an efficient process for sweeping the loose sand particles out of the underground formation in a controlled fashion. The present invention includes at least three embodiments for magnetizing the loose sand particles, including direct magnetization, contacting the sand particles with a magnetizing reagent, and contacting the sand particles with paramagnetic nanoparticles.

17 Claims, 3 Drawing Sheets

SAND PRODUCTION CONTROL THROUGH THE USE OF MAGNETIC FORCES

FIELD OF THE INVENTION

The present invention relates to a method for controlling the amount of sand produced from a wellbore. More particularly, the present invention relates to a method of using magnetic forces to control the flow of loose sand particles within an underground formation to prevent the loose sand particles from damaging downhole tools.

DESCRIPTION OF THE RELATED ART

A typical wellbore includes a production zone from which well fluid is produced and communicated to the surface of the well through a production string. At certain locations along the production string, small perforations are formed in order to allow well fluid to enter the production string from an underground formation. However, during drilling of the wellbore, particularly in unconsolidated or poorly consolidated formations, the radial area surrounding the wellbore is exposed to high tangential stresses, with the extra stress resulting in an increase in loosely held sand particles within the underground formation. These sand particles can enter the production string through the perforations and result in the inadvertent collection of sand, i.e. "sand production," in the produced fluid stream.

In order to limit sand production from unconsolidated formations, various mechanical methods have been employed for preventing formation sands from entering the production stream. For instance, gravel packs, screens, stand alone perforated/slotted lines and expandable sand screens control the loose sand particles inside the wellbore; however over time, these particles accumulate within the wellbore, leading to tool failure and increased pressure drops. Therefore, there is a need for a method of controlling sand production when producing from poorly consolidated formations that (1) allows for longer run times, (2) does not result in increased pressure drops, and (3) does not lead to premature tool failure.

SUMMARY OF THE INVENTION

The present invention is directed to a process that satisfies at least one of these needs. The invention includes a process for reducing the amount of produced sand from an underground formation through the use of magnetic forces. The process includes providing magnetized loose sand particles. In one embodiment, providing the magnetized loose sand particles includes the steps of magnetizing a portion of loose sand particles that is located within the underground formation in a producing section adjacent to a wellbore. An alternate embodiment of providing magnetized loose sand particles includes identifying loose sand particles that are compositionally magnetic. After providing the magnetized loose sand particles, a magnetic force is applied from a magnet source to the magnetized loose sand particles in the producing section of the underground formation, and hydrocarbons are produced from the underground formation via the wellbore. In one embodiment, the magnetic force can be in the form of an AC magnetic field. In one embodiment, the magnetic force is applied in a continuous fashion during production. The magnetic force can be created from a magnet source. Preferably, the magnetic source is operable to create the magnetic force such that the magnetic force can emanate a distance from the magnetic source. In a preferred embodiment, the distance is at least five times the radius of the wellbore. Due to the applied magnetic force, a substantial portion of the magnetized loose sand particles experience a repelling force that is greater than the drag force resulting from the movement of the hydrocarbons. This in turn causes the substantial portion of the magnetized loose sand particles to remain within the underground formation, thereby allowing the produced hydrocarbons to contain reduced amounts of loose sand particles as compared to hydrocarbons produced not in accordance with an embodiment of the present invention.

In accordance with embodiments of the present invention, the step of magnetizing the loose sand particles can be accomplished in several ways. For example, in an embodiment where the loose sand particles are of a ferromagnetic type, such as $Fe_3O_4$, the loose sand particles can be magnetized through direct magnetization. Direct magnetization includes allowing a ferromagnetic material to pick up magnetism by exposing it to an electromagnetic field. One method of accomplishing this would be to use a high strength magnetic field created by a capacitor through a solenoid. In one embodiment, the high strength magnetic field causes the sand particles to become magnetized. Preferably, this causes the sand particles to stick together, even in the absence of an applied magnetic field, which advantageously limits the sand particles' ability to traverse through the pores within the underground formation. In another embodiment, magnetization can be achieved by contacting the outer surface of the loose sand particles with a magnetizing reagent to coat the loose sand particles to create magnetized sand particles. This method of magnetization is particularly useful when the sand particles are not composed of a ferromagnetic type.

In yet another embodiment, the loose sand particles can be magnetized by coating the loose sand particles with paramagnetic nanoparticles. In instances where there are formation fluids filling the near wellbore pore space, it is preferable to displace the formation fluids using a preflush. The preflush can include a surfactant that is operable to improve the surface of the formation grains before pumping the magnetizing reagents or fluids having paramagnetic nanoparticles. Acceptable surfactants include any type of mutual solvent that can dissolve brine and oil simultaneously. One such exemplary example includes glycol ether. In one embodiment, the preflush can include fluid(s) that is/are used in classic enhanced oil recovery processes. In one embodiment, the preflush can remove the brine and oil, and impart a negative charge on the outer surface of the sand particles. In one embodiment, the preflush includes a sodium carbonate solution. Preferably, the preflush removes the brine and oil, and forces the sand surfaces to take on a negative charge. In another embodiment, iron oxide particles that are covered with either neutrally charged (polymer) coatings, or positively charged iron oxide particles can be used. In embodiments using iron oxide, the goal is to get the iron oxide particles to adhere to the sand surfaces, and then polarize them. This causes them to stick together, which holds the sand grains together, thereby beneficially limiting sand production. These reagents or fluids can be pumped to the desired section of the formation from the surface. The loose particles are then magnetized by contacting their surfaces with magnetizing reagent.

In one embodiment, the paramagnetic nanoparticles can include ferric ions, magnetite ions, and combinations thereof. In embodiments using a magnetic fluid, wherein magnetic fluids include magnetizing reagents, ferrofluids, paramagnetic nanoparticles, or combinations thereof, the step of magnetizing the loose sand particles includes isolating an identified section using packers and pumping the magnetic fluid into the identified section of the wellbore, preferably using coiled tubing. In one embodiment, the magnetic fluid is pressured into the underground formation to a distance of at least five times the radius of the wellbore. In one embodiment, the magnetic force supplies a repelling force as to the loose sand particles such that the force permeates into the underground formation a distance of at least five times the radius of the wellbore, as described by the analytical solution (also called the Kirsch solution) related to the stress around the borehole.

In another embodiment of the present invention, the process can include an optional preflushing step prior to the magnetizing step in which the underground formation is preflushed with a solvent in order to miscibly displace a portion of the oil and brine within the underground formation. Preferably, the preflushing step displaces oil and brine at least two to three feet away from the wellbore. The amount of preflush fluid volume required is a function of the formation pore volume and the interval to be treated. In one embodiment, the underground formation is treated with the solvent for at least two hours. The solvent can be introduced into the underground formation by pumping the solvent directly downhole or through coil tubing. In another embodiment, the well can be shut in for at least two hours following the introduction of the magnetizing fluids after the preflushing step in order to ensure the sand particles have obtained a proper coating. This step helps to control the pore fluid composition and sand particle's surface characteristics such that the sand particles are efficiently coated. This pre-flush step enhances the overall process by helping to ensure minimal amounts of oil or water molecules come into contact with the magnetic fluid.

The magnetic force can be supplied by an electromagnet or by using an induced metal as a magnetic source. In one embodiment, a section of casing can be used to provide the magnetic force, and in another embodiment, the magnet source can be disposed within the wellbore. In embodiments in which the magnet source is disposed within the wellbore, the source is preferably located proximally to the perforations, and can be hung as a liner and powered in a similar fashion as a submersible pump. In one embodiment, the magnetic force is applied during production of hydrocarbons. In embodiments using an electromagnet, the polarity of the magnetic force can be reversed in order to clean out the underground formation of loose sand particles in a controlled fashion.

In one embodiment, the process can further include monitoring the produced hydrocarbons for levels of loose sand particles and adjusting the magnitude of the magnetic force in order to keep the levels of loose sand particles in the produced hydrocarbons below a target value.

In another embodiment of the present invention, the process can include introducing the magnetizing fluid into the underground formation having loose sand particles and hydrocarbons, such that the magnetizing fluid contacts the outer surfaces of the loose sand particles, thereby creating magnetized loose sand particles. The magnetic force is then applied to the producing section of the underground formation, such that a substantial portion of the magnetized loose sand particles experiences a repulsion force. The hydrocarbons are then produced from the underground formation via the wellbore. The repulsion force exceeds the drag force created during the producing step enough to repel the substantial portion of the magnetized loose sand particles away from the wellbore, such that the produced hydrocarbons contain reduced amounts of loose sand particles as compared to hydrocarbons produced without the application of the magnetic force.

In another embodiment of the present invention, the process for controlling the production of sand from the underground formation can include magnetizing loose sand particles and controlling the movement of the loose sand particles through the application of a magnetic force in the producing section of the underground formation. The underground formation includes loose sand particles and hydrocarbons. The magnetic force is operable to keep a substantial portion of the loose sand particles within the underground formation when the magnetic force has a first polarity, and the magnetic force is operable to sweep the substantial portion of the loose sand particles from the underground formation when the magnetic force has a second polarity.

BRIEF DESCRIPTION OF THE DRAWINGS

So that the manner in which the above-recited features, aspects and advantages of the invention, as well as others that will become apparent, are attained and can be understood in detail, more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

Figure 1:
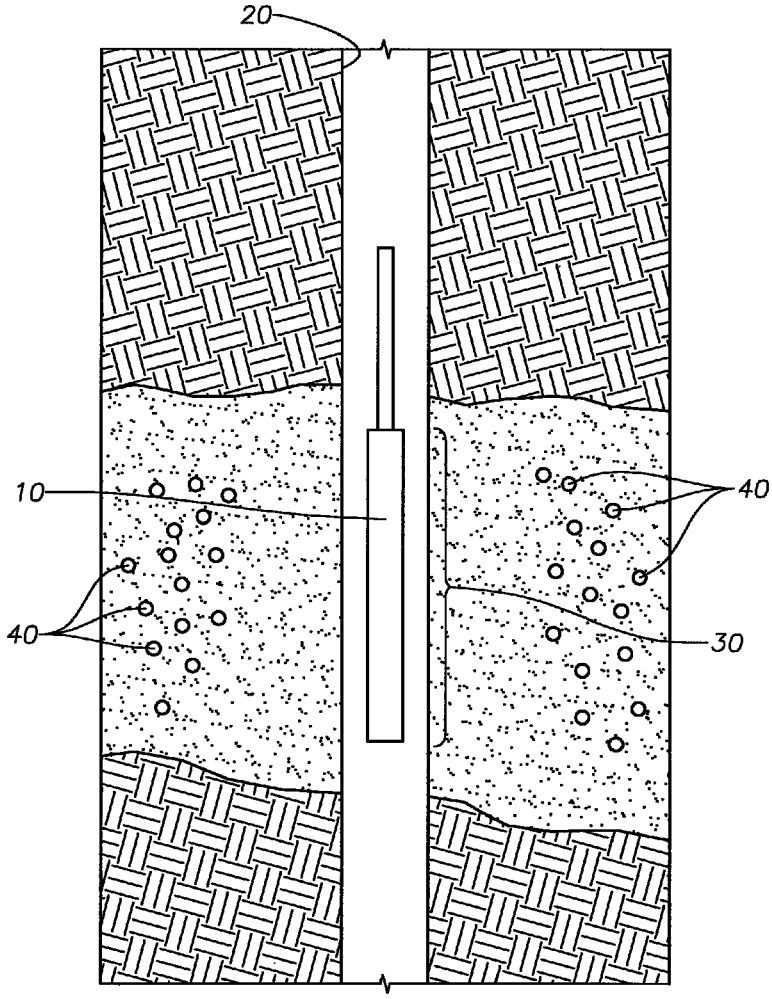
FIG. 1 shows one embodiment of the present invention.

In FIG. 1, magnet source 10 is disposed within wellbore 20 proximate producing section 30 of the underground formation. Magnetized loose sand particles 40 can be either repelled or attracted to magnet source 10 depending upon the desired function. For example, in one embodiment of the present invention, the polarity of magnet source 10 and magnetized loose sand particles 40 are the same, such that magnetized loose sand particles 40 experience a repulsive force. In another embodiment of the present invention, the polarities of magnet source 10 and magnetized loose sand particles 40 can be opposite, such that magnetized loose sand particles 40 experience a pulling force towards magnet source 10. This can advantageously allow for a controlled cleaning of the underground formation of magnetized loose sand particles 40. In one embodiment, the magnet source is proximal to the formation perforations. Magnet Sales & Manufacturing Company, Inc provides customizable magnets. Those of ordinary skill in the art will readily recognize other acceptable commercial magnet companies.

Figure 2:
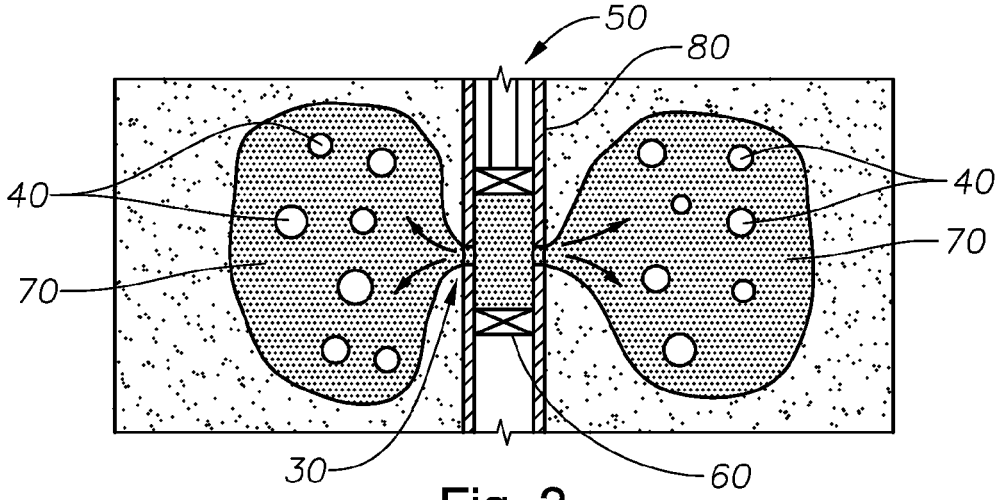
FIG. 2 shows another embodiment of the present invention.

FIG. 2 displays an embodiment of the present invention using coiled tubing 50 and packers 60 to introduce magnetizing fluid 70 into the underground formation via producing section 30 such that loose sand particles 40 are contacted with magnetizing fluid 70. In one embodiment, the magnetizing fluid can be paramagnetic nanoparticles suspended in a carrier fluid. These paramagnetic nanoparticles include ferric ions, magnetite ions, hematite ions, and maghemite ions. These paramagnet nanoparticles are suspended in a carrier fluid such as an organic solvent or water. Such fluids are available in the industry and are described in U.S. Pat. No. 4,834,898.

In another embodiment, magnetizing fluid 70 can include a magnetizing reagent (not shown) that includes water and particles of a magnetic material. Nonmagnetic loose sand particles, particularly those having silica, can be rendered magnetic by contacting their surfaces with a magnetizing reagent comprising water containing particles of a magnetic material, each of which has a two layer surfactant coating including an inner layer and an outer layer. The inner layer covers the magnetic particle and can be a monomolecular layer of a first water soluble, organic, heteropolar surfactant containing at least three carbon atoms and having a functional group on one end which bonds with the magnetic particle. The outer layer coats the inner layer and can be a monomolecular layer of a second water soluble, organic heteropolar surfactant containing at least three carbon atoms and having a hydrophobic end bonded to the hydrophobic end of the first surfactant and a functional group on the other end capable of bonding with the particles to be magnetized. U.S. Pat. No. 4,834,898 discloses such a reagent that is operable for use in accordance with an embodiment of this invention, the disclosure of which is herein incorporated by reference in its entirety. Ferrofluids generally contain ferromagnetic particles having diameters that are larger than 20 nm, whereas paramagnetic or superparamagnetic particles have diameters less than 20 nm. Ferromagnetic particles of approximately 50 nm are preferred. Generally speaking, paramagnetic particles are those that have a small and positive susceptibility to magnetic fields. These materials are slightly attracted by a magnetic field and the material does not retain the magnetic properties when the external field is removed. Paramagnetic properties are due to the presence of some unpaired electrons, and from the realignment of the electron orbits caused by the external magnetic field. Whereas ferromagnetic particles are those that have a large and positive susceptibility to an external magnetic field. They exhibit a strong attraction to magnetic fields and are able to retain their magnetic properties after the external field has been removed. Ferromagnetic materials have some unpaired electrons so their atoms have a net magnetic moment. They get their strong magnetic properties due to the presence of magnetic domains. In these domains, large numbers of atom's moments ($10^{12}$ to $10^{15}$) are aligned parallel so that the magnetic force within the domain is strong. When a ferromagnetic material is in the unmagnitized state, the domains are nearly randomly organized and the net magnetic field for the part as a whole is zero. When a magnetizing force is applied, the domains become aligned to produce a strong magnetic field within the part.

As noted earlier, during creation of the well bore, the tangential stresses are relatively higher in the areas immediately surrounding the well bore, which results in the creation of additional loose sand particles 40 proximate the well bore. Consequently, certain embodiments of the present invention can further provide that magnetizing fluid 70 permeate a distance of at least five times the radius of the well bore, such that loose sand particles 40 within this aforementioned area can be magnetized and subsequently repelled or attracted by the magnetic force as desired.

Figure 3A:
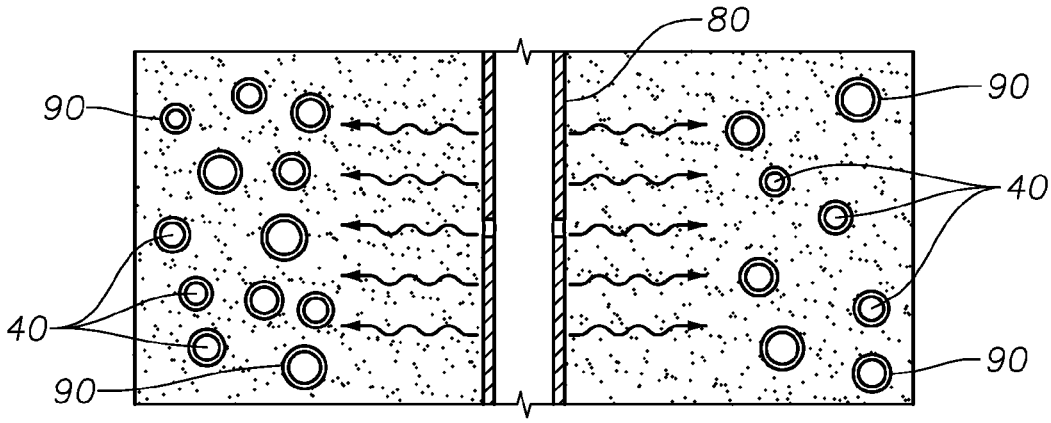
FIG. 3*a* shows another embodiment of the present invention.

FIG. 3*a* displays an embodiment of the present invention wherein casing 80 provides the magnetic force. Those of ordinary skill will readily recognize that the casing, which is preferably a metal such as steel, can be directly magnetized through known methods, such as induced magnetism, or can be made into an effective electromagnetic by means of passing an electrical current through the casing.

Loose sand particles 40 are surrounded by magnetic coatings 90 as a result of contact with magnetizing fluid 70. In one embodiment, these magnetic coatings 90 can include a plurality of paramagnetic nanoparticles. In another embodiment in which loose sand particles 40 contain silica, these magnetic coatings 90 are formed by contacting loose sand particles 40 with the magnetizing reagent having water and particles of a magnetic material described previously.

Figure 3B:
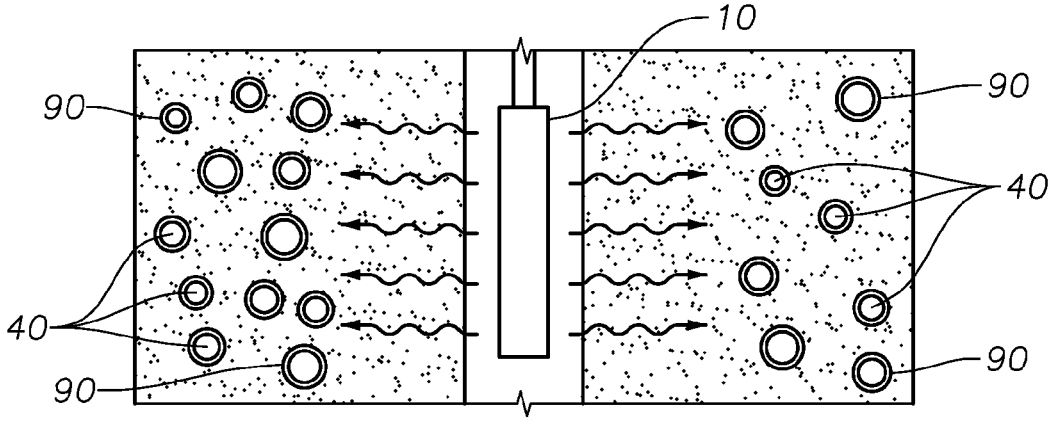
FIG. 3*b* shows another embodiment of the present invention.

FIG. 3*b* displays an embodiment of an open hole completion in which there is no casing in the producing section of the well bore. In this embodiment, magnet source 10 is disposed below the production tubing. Magnet source 10 is lowered inside the wellbore below the production tubing and facing the open hole formation with sand production. The magnet source is preferably demagnetized during insertion and removal from the borehole.

Figure 5:
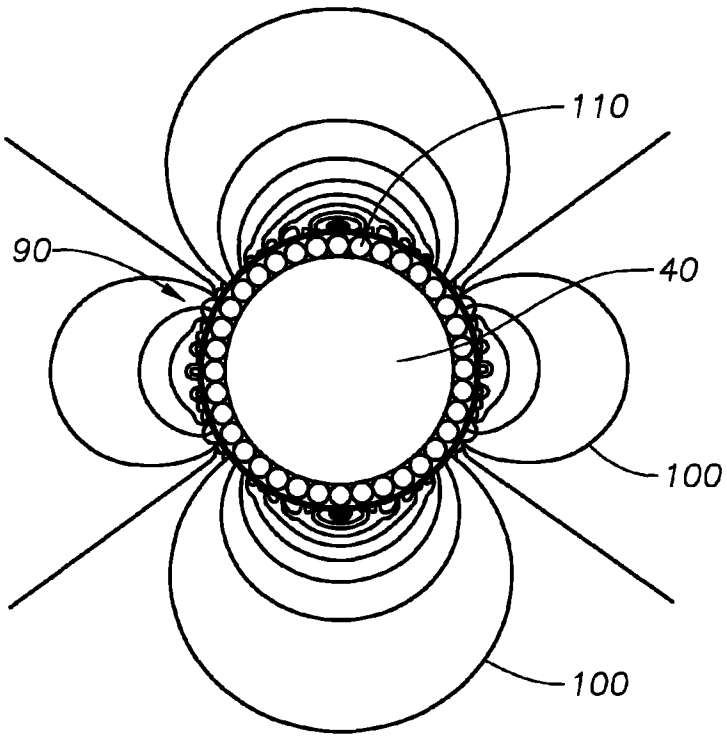
FIG. 5 shows an embodiment of the present invention.
Figure 4:
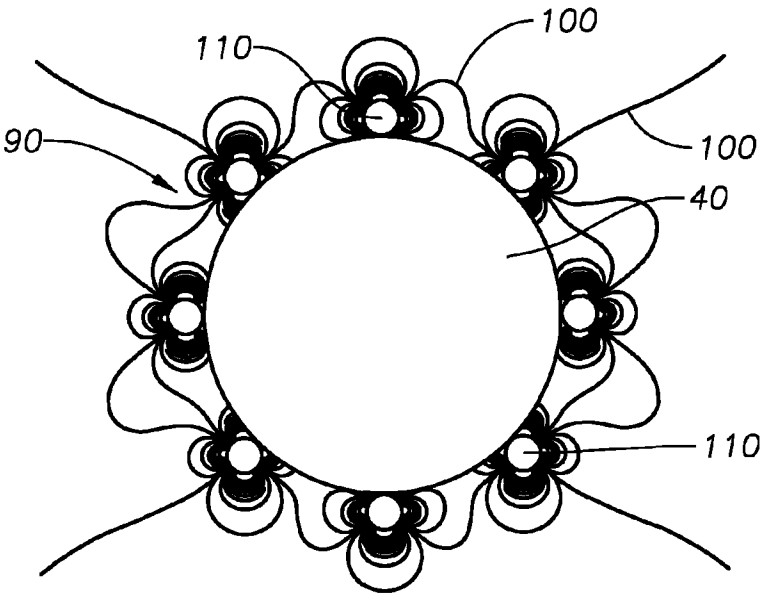
FIG. 4 shows an embodiment of the present invention.

FIG. 4 shows a demonstrative microscopic view of contour plot 100 surrounding an individual loose sand particle 40 at a low surface concentration. Contour plot 100 results from the attachment of paramagnetic particles 110 to outer surface of loose sand particle 40. In FIG. 5, loose sand particle 40 has a high surface concentration of paramagnetic particles 110, thereby creating a more significant and powerful contour plot 100 as a result of magnetic coating 90 that essentially acts like a shell around loose sand particle 40.

One of ordinary skill in the art will recognize that magnetic coatings 90, loose sand particles 40 and other items identified in the figures are not necessarily drawn to scale, but rather, might appear larger in proportion for ease of identification.

Having described the invention above, various modifications of the techniques, procedures, materials, and equipment will be apparent to those skilled in the art. While various embodiments have been shown and described, various modifications and substitutions may be made thereto. Accordingly, it is to be understood that the present invention has been described by way of illustration(s) and not limitation. Additionally, the present invention may suitably comprise, consist or consist essentially of the elements disclosed and can be practiced in the absence of an element not disclosed. It is intended that all such variations within the scope and spirit of the invention be included within the scope of the appended claims.

What is claimed is:

1. A process for controlling the production of loose sand particles from an underground formation during the production of hydrocarbons, the process comprising the steps of:

introducing a magnetic source into a well bore traversing the underground formation such that it is positioned proximate to a producing section within the underground formation, where the producing section of the underground formation comprises loose sand particles and production fluid and where the production fluid includes hydrocarbons;

treating at least some of the loose sand particles located within the underground formation such that the treated loose sand particles form that are operable to respond to the introduction of a magnetic field;

operating the magnetic source such that a continuous magnetic field is generated from the magnetic source that penetrates the producing section of the underground formation for a distance from the magnetic source, where the treated loose sand particles within the continuous magnetic field experience a continuous repelling force directed away from the well bore; and producing the production fluid from the producing section of the underground formation at a production rate such that the treated loose sand particles experience a production drag force, where the production drag force is associated with the production rate and is directed towards the well bore;

where the continuous repelling force is equal to or greater than the production drag force on the treated loose particles such that the treated loose sand particles within the distance from the magnetic source are not produced with the production fluid from the producing section.

2. The process of claim 1 where the loose sand particles are ferromagnetic, and the step of treating at least some of the loose sand particles comprises magnetizing the loose sand particles by exposing the loose sand particles to an electromagnetic field such that the treated loose sand particles form.

3. The process of claim 2 where the treated loose sand particles comprise $Fe_3O_4$.

4. The process of claim 1 where the step of treating at least some of the loose sand particles comprises introducing a magnetizing fluid into the producing section such that the magnetizing fluid contacts with and adheres to an outer surfaces of individual loose sand particles such that the treated loose sand particles form, where the adherent on the outer surface of the treated loose sand particles is resistant to the production fluid.

5. The process of claim 4 where the magnetizing reagent is introduced into the producing section such that the magnetizing reagent contacts the producing section for a distance of at least five times the radius of the well bore.

6. The process of claim 4 where the magnetizing fluid is selected from the group consisting of magnetizing reagents, ferrofluids, magnetorheological fluids, paramagnetic nanoparticles suspended in an aqueous carrier solution, and combinations thereof.

7. The process of claim 1 where the step of treating at least some of the loose sand particles comprises introducing a reagent comprising paramagnetic nanoparticles into the producing section such that the reagent contacts with and adheres to an outer surfaces of individual loose sand particles such that the treated loose sand particles form, where the adherent on the outer surface of the treated loose sand particles is resistant to the production fluid.

8. The process of claim 7 where the paramagnetic nanoparticles are selected from the group consisting of ferric ions, magnetite ions, hematite ions, maghemite ions and combinations thereof.

9. The process of claim 1 further comprising the step of introducing a pretreatment surfactant into the portion of the producing section where the continuous magnetic field is present prior to the step of treating at least some of the loose sand particles such that any production fluid present in the portion of the producing section where the continuous magnetic field is present is evacuated.

10. The process of claim 9 where the pretreatment surfactant is operable to dissolve both a brine and hydrocarbons.

11. The process of claim 9 where the pretreatment surfactant comprises a glycol ether.

12. The process of claim 1 where the magnetic source introduced into the well bore comprises a portion of a casing for the well bore, where the casing contacts a well bore wall of the well bore and is operable to permit fluid to pass between the well bore and the producing section at the producing section of the underground formation.

13. The process of claim 1 where the magnetic source introduced into the well bore comprises an electromagnet that is operable to be introduced into, positioned within, and removed from the well bore.

14. The process of claim 1 where the distance from the magnetic source is at least about five times the radius of the well bore.

15. A process for controlling the production of sand from an underground formation during the production of hydrocarbons, the process comprising the steps of:

introducing a magnetizing fluid into a producing section of an underground formation, where the producing section of the underground formation comprises loose sand particles and production fluid and where the production fluid includes hydrocarbons, such that the magnetizing fluid contacts with and adheres to an outer surfaces of the loose sand particles such that the treated loose sand particles form, where the adherent on the outer surface of the treated loose sand particles is resistant to the production fluid, and such that the treated loose sand particles are operable to respond to the introduction of a magnetic field;

introducing a continuous magnetic field into the producing section of the underground formation such that the treated loose sand particles within the continuous magnetic field experience a constant repelling force directed away from a well bore; and producing the production fluid the producing section of the underground formation at a production rate such that the treated loose sand particles experience a production drag force, where the production drag force is associated with the production rate and is directed towards the well bore, where the constant repelling force is equal to or greater than the production drag force on the treated loose particles such that the treated loose sand particles within the distance from the magnetic source are not produced with the production fluid from the producing section.

16. The process of claim 15 where the magnetizing fluid is selected from the group consisting of magnetizing reagents, ferrofluids, magnetorheological fluids, paramagnetic nanoparticles suspended in a carrier solution, and combinations thereof.

17. The process of claim 16 where the paramagnetic nanoparticles are selected from the group consisting of ferric ions, magnetite ions, hematite ions, maghemite ions and combinations thereof; and where the carrier fluid is selected from the group consisting of an organic solvent, water and combinations thereof.

* * * * *